US005720695A

United States Patent [19]

Eckmann

[11] Patent Number: 5,720,695

[45] Date of Patent: Feb. 24, 1998

[54] WEIGHT AUGMENTATION DEVICE

[75] Inventor: James A. Eckmann, Libertyville, Ill.

[73] Assignee: Sportworks, Ltd., Vernon Hills, Ill.

[21] Appl. No.: 787,581

[22] Filed: Jan. 22, 1997

[51] Int. Cl.[6] ..... A63B 21/06

[52] U.S. Cl. ..... 482/72; 482/96; 482/97; 248/227.3; 248/231.31

[58] Field of Search ..... 482/72, 96, 97, 482/94, 93, 148, 51; 224/456, 536; 248/226.11, 227.3, 231.31; 269/77, 78; 403/374, 376, 378

[56] References Cited

U.S. PATENT DOCUMENTS

| | | | |
|---|---|---|---|
| 2,855,199 | 10/1958 | Noland et al. | 482/97 |
| 5,135,330 | 8/1992 | Chen | 403/374 |
| 5,356,358 | 10/1994 | Chen | 482/96 |
| 5,549,231 | 8/1996 | Fletcher et al. | 224/536 |
| 5,580,341 | 12/1996 | Simonson | 482/97 |

*Primary Examiner*—Richard J. Apley
*Assistant Examiner*—John Mulcahy
*Attorney, Agent, or Firm*—Polster, Lieder, Woodruff & Lucchesi, LC

[57] ABSTRACT

A weight augmenting device for a rider-type exercise machine comprises a U-shaped bracket with stiffly flexible legs and a bridging cross piece joining the legs along one edge of the legs, the legs being spaced a distance closely to embrace opposite sides of a rectangular post. A clamping mechanism squeezes the legs against the post. A weight holding finger is mounted at one end to the bridging cross piece and projects in a direction away from the legs. Weights are mounted on the finger. The bracket is selectively mountable on and demountable from the exercise machine post, which itself is pivoted at one end, and can be moved along the length of the post toward and away from the pivot point of the post, so as to increase or decrease the force necessary to move the post around its pivot.

7 Claims, 5 Drawing Sheets

WEIGHT AUGMENTATION DEVICE

CROSS-REFERENCE TO RELATED APPLICATIONS

This application contains subject matter related to application Ser. No. 29/064,376, filed Dec. 30, 1996, the disclosure of which is incorporated herein by reference.

STATEMENT REGARDING FEDERALLY SPONSORED RESEARCH OR DEVELOPMENT

Not Applicable.

BACKGROUND OF THE INVENTION

In exercise machines in which a post is pivoted and moved backward and forward by the person exercising, such, for example as a machine known as the NordicRider™ exerciser, a product of the NordicTrack Company, adding weight to the post or posts as in the case of the NordicRider, will increase the effort expended by the user.

One of the objects of this invention is to provide a device by which a force required to operate an exercise device in which a post is moved through an arc is augmented easily.

Another object is to provide such a device which can be adjusted along the length of the post to move toward and away from the pivot point of the post, easily.

Other objects will become apparent to those skilled in the art in light of the following description and accompanying drawings.

BRIEF SUMMARY OF THE INVENTION

In accordance with this invention, generally stated a weight augmenting device for an exercising machine is provided which includes a U-shaped bracket with stiffly flexible legs and a bridging cross piece joining the legs along one edge thereof. The legs are spaced a distance closely to embrace opposite sides of a post member rectangular in transverse cross-section. In the preferred embodiment, a cam arrangement is provided, connected to the legs, by which the legs are squeezed against opposite flat sides of the rectangular post member to hold the bracket in a desired position. A weight holding finger is mounted at one end to the bridging cross piece and projects in a direction away from and at an upwardly tending angle from the member on which the bracket is mounted. The cam arrangement provides a quick release mechanism, whereby the bracket can be moved along the post member to a desired position, and clamped easily. The weights can be of the type shown in my co-pending application Ser. No. 29/064,376.

In the preferred embodiment, the mechanism by which the legs of the bracket are squeezed against the rectangular posts include a throughbolt threaded at one end and provided with a head on another end. The throughbolt extends through aligned holes in the two legs. The threaded end is capped with a bolt which can be screwed down to regulate the tension to be applied to the screw bolt. The head at the other end is provided with a diametrically extending hole through it. A thimble, with diametric holes complementarily arranged with respect to the hole in the head, is mounted to exert a force on a flat outer surface of one of the legs, the nut on the threaded end of the throughbolt abutting the outer surface of the opposite leg.

A cam positioned between two concentric bearing areas, is mounted in the head hole. The two beating areas are journaled in the holes in the thimble. A handle is connected to the cam.

In mounting the bracket to the rectangular post, the throughbolt is removed and the legs slipped over the opposite sides of the rectangular post, with the weight-holding finger projecting forwardly and upwardly. The throughbolt is then placed through the holes in the legs, with the cam and thimble assembled, and the nut at the threaded end is screwed down against the outer surface of one of the legs. A handle part of the cam is arranged for ready access, and when it is moved, the cam engages the surface defining the passage through the head, to move the throughbolt against the bias of the legs until the legs have moved into snug engagement with opposite flat side surfaces of the post, holding the bracket against movement. The bracket may be covered with a resilient plastic or rubber coating, to increase the frictional engagement of the legs with the post, and also to minimize the effect of a person's bumping the bracket accidentally.

BRIEF DESCRIPTION OF THE SEVERAL VIEWS OF THE DRAWINGS

In the drawings.

FIG. 13 A is a top plan view of a cam mechanism and handle;

DETAILED DESCRIPTION OF THE INVENTION

Figure 1:
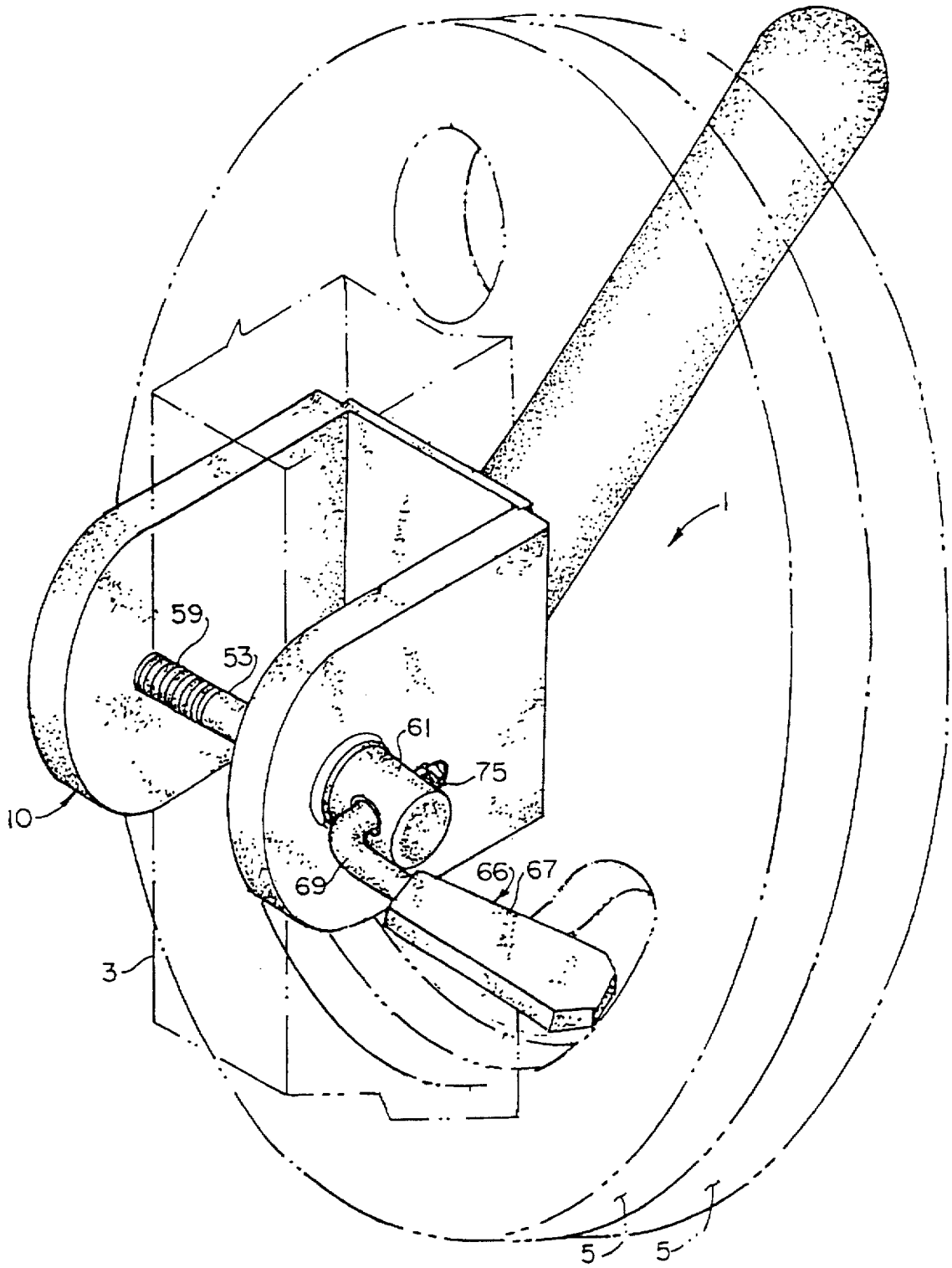
FIG. 1 is a view in perspective of a bracket of this invention, with a post of an exercise machine and weights shown in phantom lines.
Figure 2A:
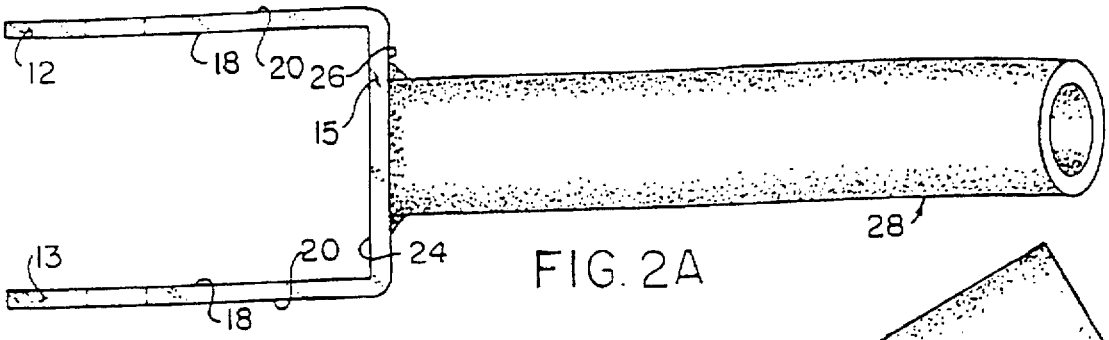
FIG. 2A is a top plan view of the bracket without a covering.
Figure 2B:
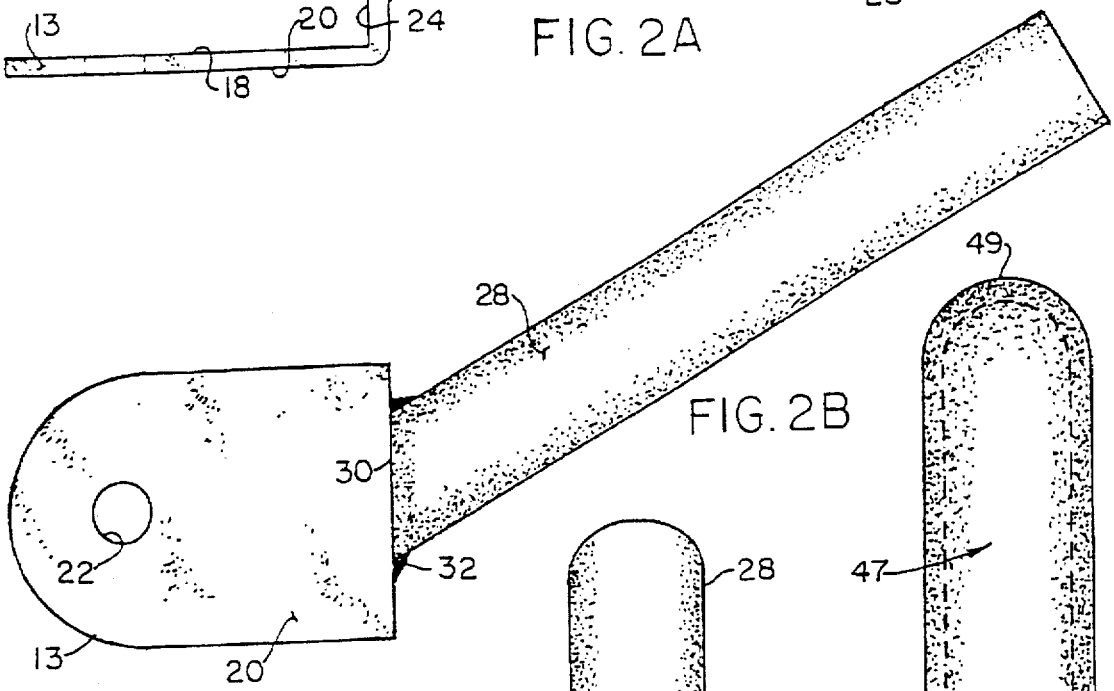
FIG. 2B is a view in side elevation of the bracket shown in FIG. 2A.
Figure 3A:
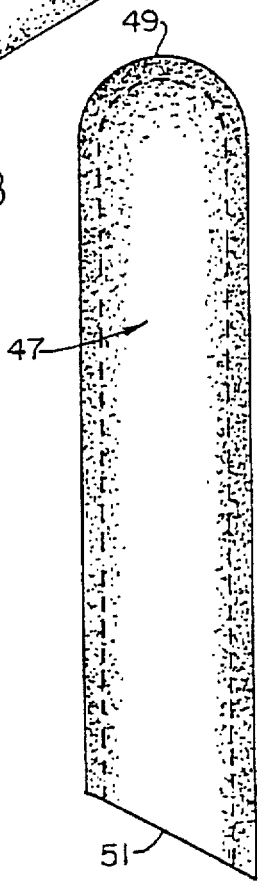
FIG. 3A is a view in side elevation of a cot or sheath that is put in place on a projection of the bracket.
Figure 2C:
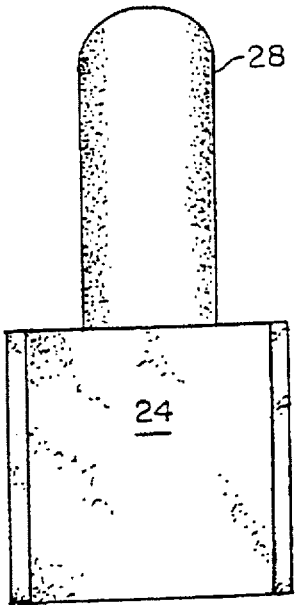
FIG. 2C is a view in rear elevation.
Figure 2D:
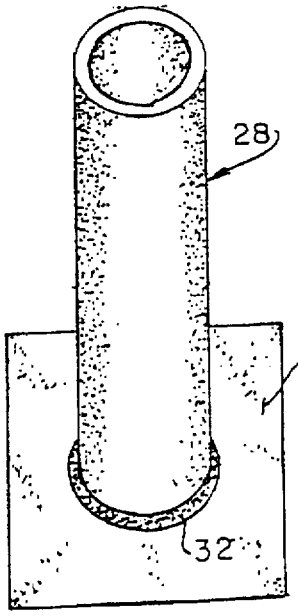
FIG. 2D is a view in front elevation.
Figure 3B:
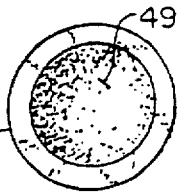
FIG. 3B is a bottom plan view of the cot of FIG. 3A.
Figure 4A:
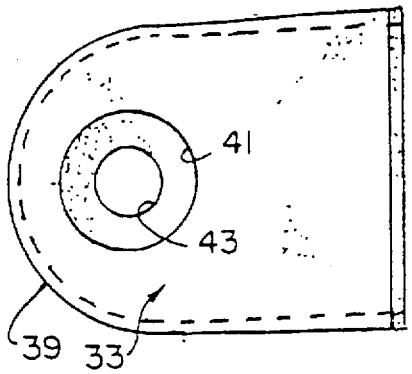
FIG. 4A is a view in side elevation of a cover for the legs of the bracket, and part of the bridging piece of the bracket.
Figure 4B:
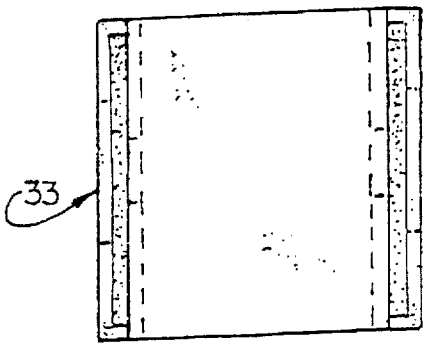
FIG. 4B is a view in rear elevation of the cover of FIG. 4A.
Figure 4C:
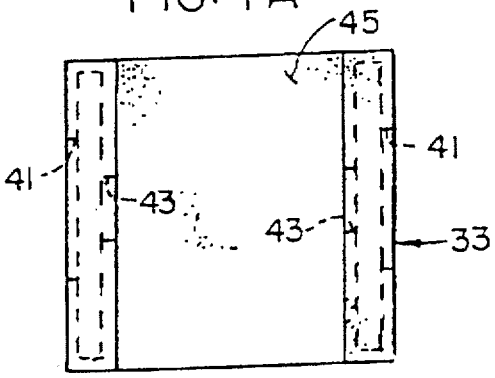
FIG. 4C is a view in front elevation of the cover.
Figure 4D:
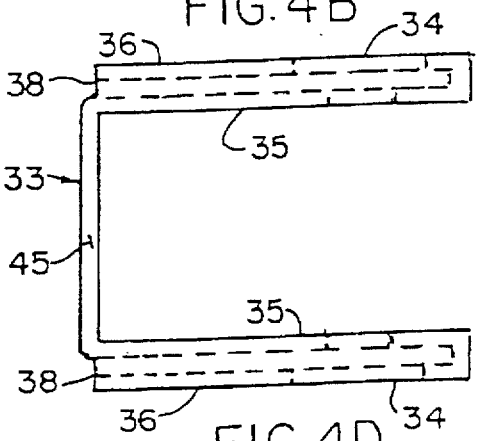
FIG. 4D is a top plan view.
Figure 5:
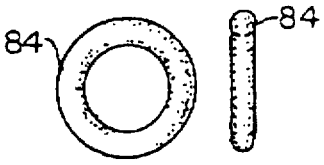
FIG. 5 is a view in plan and edge elevation of an O-ring element of an adjusting nut.
Figure 6:
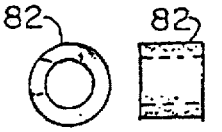
FIG. 6 is a view in end elevation and side elevation of a holding sleeve insert for the nut.
Figure 7:
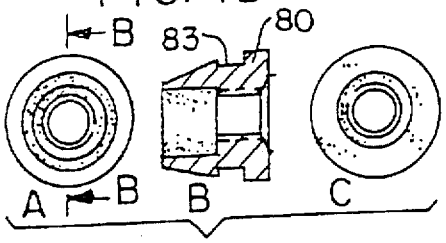
FIG. 7A is a view in front elevation of the nut.
FIG. 7B is a sectional view taken along the line B—B of FIG. 7A.
FIG. 7C is a view in rear elevation of the nut.
Figure 15:
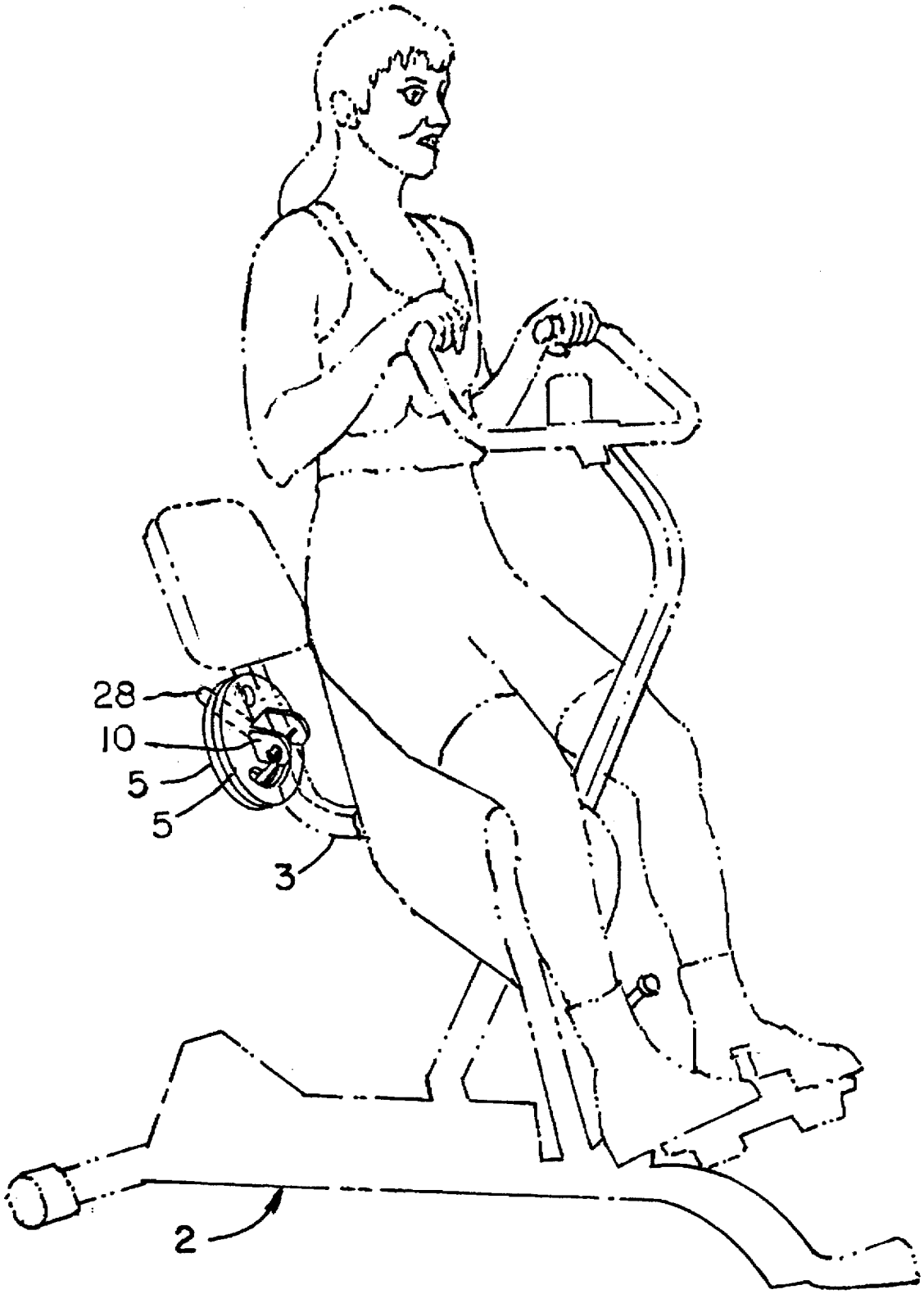
FIG. 15 shows a rider-type exercise machine.

Referring now to the drawings for an illustrative embodiment of weight augmentation device of this invention, and particularly to FIG. 1, reference numeral 1 indicates the completed device 2 mounted on a post 3 of an exercise device such as the NordicRider™. See FIG. 15. As indicated under the "Background Of the Invention", the post 3 is pivoted at its lower end and is moved backward and forward, fore and aft, by the person exercising. The device 1 is intended to carry weights 5, which may be of the type shown in applicant's co-pending application Ser. No. 29/064,376.

The device 1 includes bracket 10 made up of plate-like legs 12 and 13 and a bridging piece 15 extending between and integral with the legs 12 and 13. Each of the legs 12 and 13 has a flat inner surface 18 and a flat outer surface 20. Aligned holes 22 are formed in the legs 12 and 13, at a distance from the bridging piece to clear the post 3 when a flat inner surface 24 of the bridging piece lies against a flat surface of the post 3. The post 3 is rectangular in transverse cross-section, in the embodiment shown, square. The bridging piece 15 has a flat outer surface, to which a pipe finger or prong 28 is secured. The finger 28 has a mitered end 30, which is welded to the flat outer surface 26 of the bridging piece with a weld 32, which causes the finger 28 to project outwardly at an angle upwardly from the horizontal, so that the weights 5, mounted on the finger, are gravity biased toward the flat outer surface of the bridging piece 15.

The legs of the bracket and the inner surface 18 of the bridging piece are covered with a bracket case 33. The bracket case 33, made of plastic, has leg pockets 34, with inner walls 35, outer walls 36 and a sidewalls 37, connecting the inner and outer walls. The sidewall 37 has a closed curved end 39, and an open end 38, through which the legs are inserted into the case. The inner walls 35 of the leg pockets are joined at the open end of the leg pockets by a bridging wall 45, integral with the inner walls, which covers the flat inner surface 24 of the bridging piece 15. The outer wall 36 of both leg pockets has a relatively large opening, concentric with the holes 22 in the legs. Each of the inner walls 35 has a smaller hole, of approximately the same diameter as the holes 22, aligned with the holes 22.

A cot or sheath 47 covers the finger 28. The cot or sheath is made of a rubbery material, and has a closed, rounded or hemispherical end 49 and a mitered end 51 complementary to the mitered end of the finger 28, so as to fit neatly. The cot 47 serves several functions: it presents a neat appearance, it protects the user from the sharp end of the pipe, and it inhibits movement of the weights 5 when the device is in use.

Figure 8:
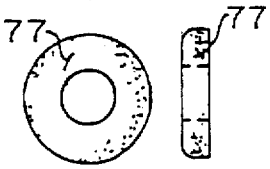
FIG. 8 is a view in front and side elevation of a washer.
Figure 9:
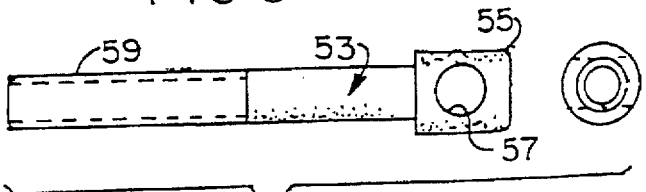
FIG. 9 is a view in side and end elevation of a throughbolt.
Figure 10:
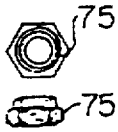
FIG. 10 is a top plan and side elevational view of a lock nut.
Figure 11:
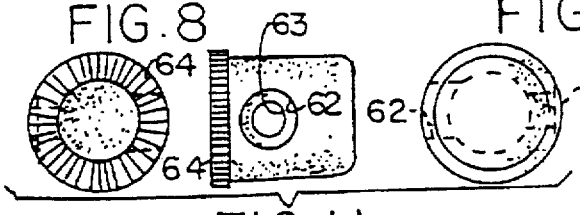
FIG. 11 is a view in front, side and rear elevation of a thimble.
Figure 12:
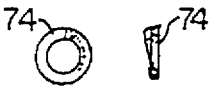
FIG. 12 is a view in front and side elevation of a lock washer.

A clamping mechanism in this embodiment includes a pitman or throughbolt 53 with a head 55 and a threaded shank 59. The head 55 has a cross-passage 57 through it. The throughbolt extends through the aligned holes 22 in the legs and the holes 41 and 43 of the bracket case. A washer 77, best illustrated in FIG. 8, is mounted in the large hole of the case pocket 34 around the leg 18, in abutment against the outer side of the leg. The threaded end 59 of the throughbolt 53 extends through the hole 22 in the leg 13, and holes 43 and 41 of the case leg pocket 34, a distance far enough to permit the mounting of a nut 80 on the projecting end, and the engagement of the threads at the end of the throughbolt 53 in a holding sleeve 82 mounted in the nut. The nut 80 has an annular seat 83, in which an O ring 84 is mounted to facilitate turning the nut by hand.

At the head end of the throughbolt, the heavy washer 77 is mounted between the head 55 and the outside surface 20 of the leg 12, within the compass of the opening 41 of the case 33.

A thimble 61 with a knurled rim at an open end, is mounted over the head 55, as shown particularly in FIG. 1. The thimble 61 has passages diametrically through it that are aligned with the cross-passage 57 of the head 55. A flat radially extending surface of the knurled rim section 64 bears against an outer radial face of the washer 77.

Figures 13A, 13B, 14:
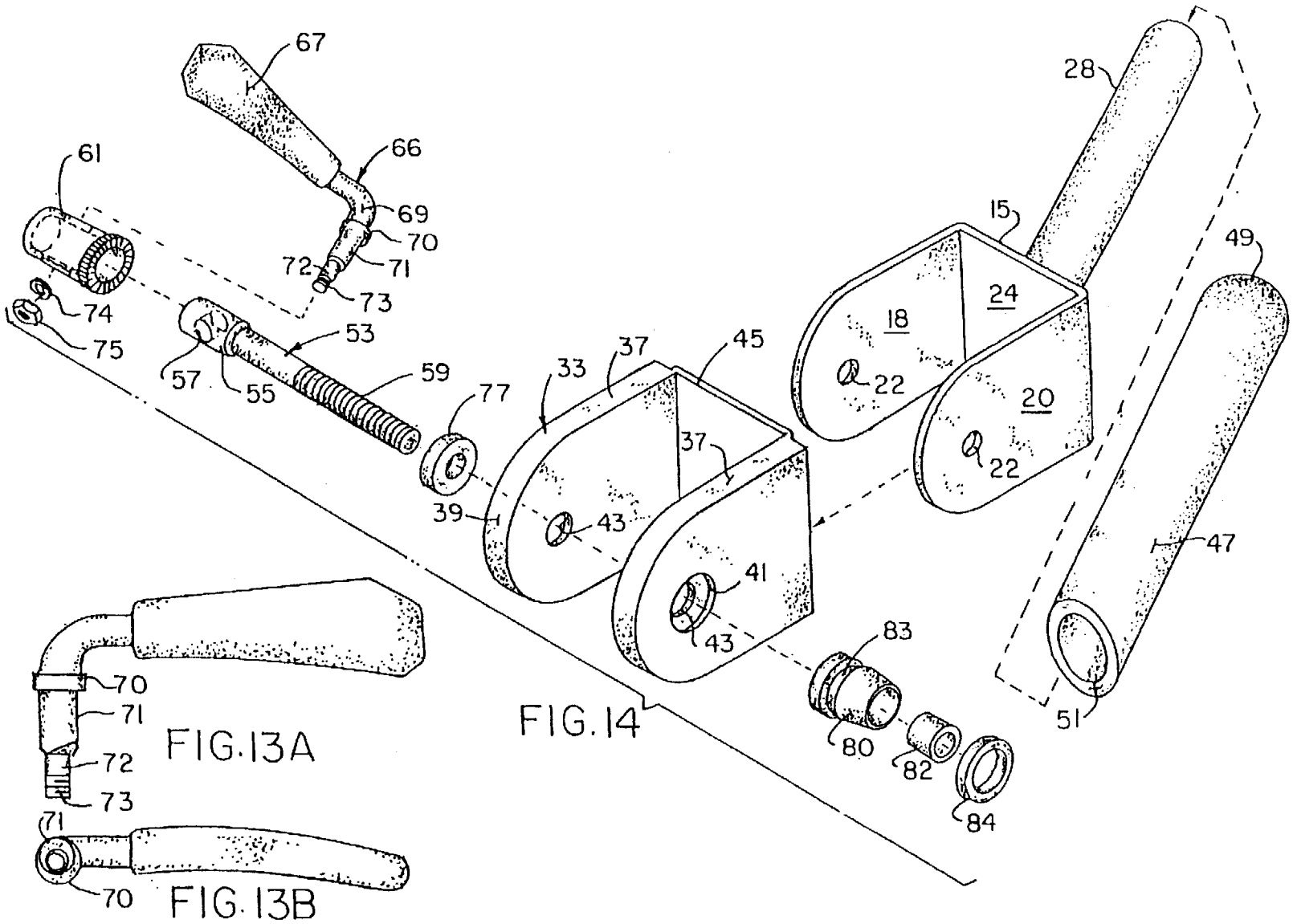
FIG. 13B is a view in side elevation of the cam mechanism.
FIG. 14 is an exploded view of the complete assemblage of bracket elements.

A cam mechanism 66 includes a shaft with beating surfaces 70 and 72, and a cam surface 71. The bearing surfaces 72 and 70 are concentric, and the cam 71 is eccentric with respect to them, as shown particularly in FIG. 13B. The bearing surface 70 is larger in diameter than the bearing surface 72, and at one point is coincident with the outermost reach of the cam 71, again as shown particularly in FIG. 13B.

One of the openings, opening 62, in the thimble is large compared with the other opening 63. The opening 62 is sized to receive and journal the bearing surface 72; the opening 62 is sized to receive and journal the bearing surface 70. At the free end of the cam shaft 69, a threaded section 73 is provided. When the cam section is mounted within the thimble and head 55, a lock washer 74 is put into place, and a nut 75 is screwed down to hold the cam mechanism in place. At the end of the shaft at which the beating surface 70 is, a handle 67 is formed, which can extend either at right angles or at an angle slightly greater than a right angle, to permit its ready manipulation. When the nut 80 has been screwed down manually against the surface 20, and the handle 67 is in a position in which the cam 71 is toward the surface 20 of the opposite leg 13, the handle can be moved to a position at which the cam 71 moves the throughbolt outwardly into the thimble 61, and the abutment of the thimble 61 against the surface 20 of the leg 12 causes the throughbolt 53 to move in a direction away from the nut 80, which will squeeze the legs 12 and 13 toward one another, clamping them firmly against the flat sides of the rectangular post 3.

In assembling the device, the cam mechanism and thimble can be assembled first, a bracket placed around the post, the throughbolt, without the nut 80, put into place and through the hole 22, the nut 80 screwed down snugly manually, and the device is ready for use.

As illustrated in the picture enclosed in the file of the application, the bracket and its accompanying weights can be mounted on the back post of the NordicRider seat. It can also be applied to the front post, or to both.

Numerous variations in the construction of this device within the scope of the appended claims will occur to those skilled in the art in the light of the foregoing disclosure. Merely by way of example, the legs of the bracket can be squeezed by another mechanism, such as a large wing nut or single lever nut, or even an external clamp, but the clamping mechanism of the preferred embodiment has the advantage of exerting a large force with a relatively small amount of effort in moving the lever handle, and the provision of the thimble that completely encloses the clamping mechanism protects the user from accidental pinching. The finger or prong can be configured differently, or provided with a rounded end without a covering sheet, but the embodiment described has the advantage of simplicity, and of tending to inhibit the movement of weight, particularly when the weights are flocked or covered with a rubbery material. The bracket of the preferred embodiment is made of ⅛" steel with enough flexibility to restore itself to its original condition after it has moved the relatively short distance between its relaxed position and its clamping position. Other materials can be used, such as a strong plastic, and the finger made integral with the bracket, but that is more difficult and expensive than the construction of the preferred embodiment. If the post to which the bracket is to be mounted has a different cross-sectional configuration, the legs of the bracket can be differently configured. Thus, if the post were round or hexagonal or octagonal, for example, the legs can be curved complementarily, and provided with ears or tabs extending outwardly from the post to provide a place for a clamping device, and a flat section to which the finger is mounted. These are merely illustrative.

I claim:

1. In combination with an exercise machine of the rider type having at least one upwardly extending member, rectangular in transverse cross-section, pivotally mounted at a lower end for rocking movement in a plane in a fore and aft direction, a weight augmenting device comprising a U-shaped bracket slideably mounted on said member for selective positioning lengthwise thereof, said bracket having stiffly flexible legs and a bridging cross piece joining said legs along one edge thereof, said legs being spaced a distance closely to embrace opposing sides of said member, means connected to said legs for squeezing said legs against said rectangular member to hold said bracket in a desired position on said member, and a weight holding finger mounted at one end to said bridging cross piece and projecting in a direction away from said member, in said plane of fore and aft movement of said member, at an upwardly tending angle.

2. The combination of claim 1 wherein the exercise machine has a handlebar post and a back rest post, both square in transverse cross-section, both of said posts moving in a common plane during use by one exercising on it, one or more of said brackets being mountable on and demountable from either or both of said posts.

3. The combination of claim 1 wherein the means for squeezing said legs comprises a two ended throughbolt threaded at one end and a nut removably mounted on said one end, said nut engaging an outside surface of one of said legs, and a head on the other end of said throughbolt, said head having a through passage in it, a cam extending within said through passage and bearing upon a surface defining said through passage, and an operating handle connected to said cam.

4. The combination of claim 3 including a thimble with holes aligned with the through passage in the head of the throughbolt, said thimble abutting an outside surface of the other of said legs, said cam having bearing areas concentric with the through passage in said head on either side of said cam, said bearing areas engaging walls defining the holes in said thimble, whereby said cam is journaled in said thimble.

5. In combination with a rider type exercise machine having at least one upstanding, moveable member, rectangular in transverse cross-section, a weight augmenting device comprising a U-shaped bracket with stiffly flexible legs and a bridging cross piece joining said legs along one edge thereof, said legs being spaced a distance closely to embrace opposing sides of said rectangular member, means connected to said legs for squeezing said legs against said rectangular member to hold said bracket in a desired position on said member, a weight holding finger mounted at one end to said bridging cross piece and projecting in a direction away from said member at an upwardly tending angle, said legs and bridging piece being made of steel, and a case surrounding said legs and covering an inside surface of said bridging piece, said case having holes concentric with holes in said legs.

6. In combination with a rider type exercise machine having at least one upstanding, moveable member rectangular in transverse cross-section, a weight augmenting device comprising a U-shaped bracket with stiffly flexible legs and a bridging cross piece joining said legs along one edge thereof, said legs being spaced a distance closely to embrace opposing sides of said rectangular member, means connected to said legs for squeezing said legs against said rectangular member to hold said bracket in a desired position on said member, a weight holding finger mounted at one end to said bridging cross piece and projecting in a direction away from said member at an upwardly tending angle, and a cot of rubbery material mounted on said finger, said cot being closed at a rounded outer end.

7. The combination of claim 6 wherein said finger is an open-ended pipe.

* * * * *

UNITED STATES PATENT AND TRADEMARK OFFICE

CERTIFICATE OF CORRECTION

PATENT NO : 5,720,695

DATED : February 24, 1998

INVENTOR(S) : James A. Eckmann

It is certified that error appears in the above-identified patent and that said Letters Patent is hereby corrected as shown below:

Col. 1, line 65
replace ""beating""
with -- bearing --.

Col. 4, line 22
replace ""beating""
with -- bearing --.

Signed and Sealed this

Ninth Day of June, 1998

*Attest:*

Bruce Lehman

BRUCE LEHMAN

*Attesting Officer*

*Commissioner of Patents and Trademarks*